United States Patent [19]

Kroll et al.

[11] 4,347,298

[45] Aug. 31, 1982

[54] ELECTROGRAPHIC DEVELOPMENT APPARATUS AND METHOD FOR USE WITH PARTIALLY-CONDUCTIVE DEVELOPER

[75] Inventors: Arthur S. Kroll, Spencerport; Frank A. Shuster, Rochester, both of N.Y.

[73] Assignee: Eastman Kodak Company, Rochester, N.Y.

[21] Appl. No.: 258,228

[22] Filed: Apr. 27, 1981

Related U.S. Application Data

[62] Division of Ser. No. 27,115, Apr. 4, 1979, Pat. No. 4,292,921.

[51] Int. Cl.[3] ..... G03G 13/06; G03G 13/08

[52] U.S. Cl. ..... 430/97; 430/106.6; 430/110; 430/117; 430/120; 430/122; 118/657

[58] Field of Search ..... 430/122, 106.6, 97, 430/110, 120, 117, 107; 118/657

[56] References Cited

U.S. PATENT DOCUMENTS 4,177,757 12/1979 Murakawa et al. ..... 430/122

4,193,376 3/1980 Hamaguchi et al. ..... 430/122

*Primary Examiner*—John D. Welsh

*Attorney, Agent, or Firm*—John D. Husser

[57] ABSTRACT

Improved electrographic development apparatus and procedure for use with partially-conductive developer employs transport of the developer through a first development zone in a direction generally countercurrent to a moving image member and through a second development zone in a direction generally co-current to the moving image member. The extent of image development within each such zone is controlled by the rate of developer transport and/or the magnitude of developer bias, so that overall development of the different portions of large solid image areas (particularly leading and trailing portions of such areas) is equalized.

11 Claims, 3 Drawing Figures

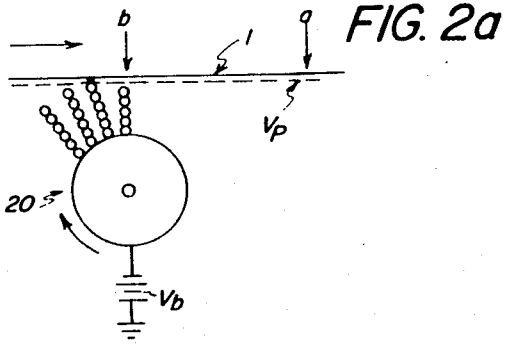
FIG. 1a
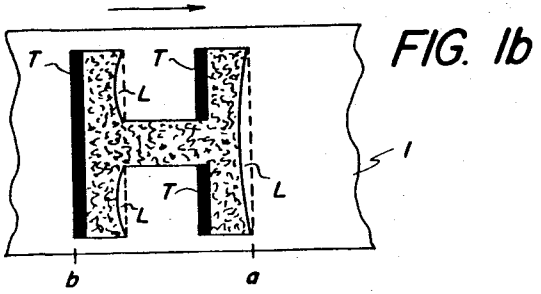
FIG. 1b
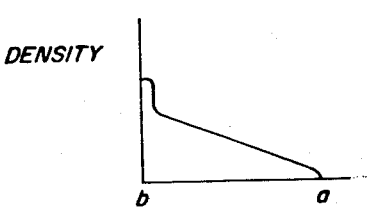
FIG. 1c
FIG. 2a
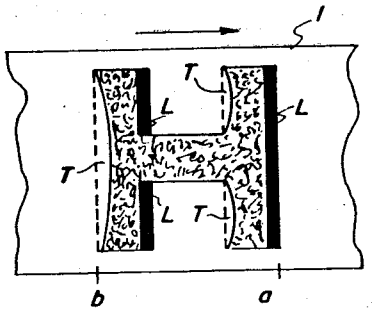
FIG. 2b
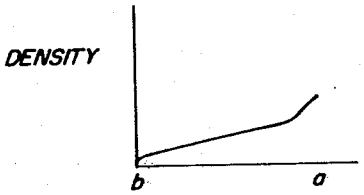
FIG. 2c

ELECTROGRAPHIC DEVELOPMENT APPARATUS AND METHOD FOR USE WITH PARTIALLY-CONDUCTIVE DEVELOPER

This is a division of application Ser. No. 027,115, filed Apr. 4, 1979, now U.S. Pat. No. 4,292,921.

BACKGROUND OF THE INVENTION

1. Field of the Invention

The present invention relates to electrographic development apparatus and process which provide enhanced development with partially-conductive developer.

2. Description of the Prior Art

In the art of electrographic reproduction, e.g., electrophotographic copying, one direction of advance is toward the production of higher quality copies at faster copying rates, e.g., to serve the intermediate run duplication market which presently requires offset printing techniques. Rapid, high quality electrographic development, i.e., the application of toner to a latent electrostatic image, has presented particular problems to efforts in this direction. This is particularly true with respect to development of large solid or large continuous tone areas of the image (i.e., image areas which bear a generally uniform charge corresponding to a generally uniform shade on the original).

Present commercial apparatus have predominately utilized cascade or magnetic brush systems, incorporating a development electrode in some form to enhance solid area development. The function of the development electrode in these devices is to cause the electric field of the large solid area to be external of the image member (rather than within the member) and thus to more accurately reflect the electrostatic surface charge of the area. This is accomplished in cascade systems by locating an electrically conductive plate opposite the development zone; the plate can be biased to a potential level to control background development. In magnetic brush systems, the metallic cylinder of the brush can be similarly biased to perform as a development electrode.

Numerous variations of such systems have been devised to facilitate increased density and uniformity of large solid areas in high speed development. For example, extended development zones and automatic bias variation (in response to feedback from the electrostatic image) have been utilized to increase density and improve uniformity. However, even with the best of these systems, there remain significant aspects for improvement.

Recently issued U.S. Pat. No. 4,076,857 discloses a new development approach which offers advantage in the attainment of increased image density in high speed operation. This approach, in general, utilizes a partially-conductive developer, as distinguished from most prior art developer mixtures, which can be characterized as substantially insulative. In this new approach, the combination of using such partially-conductive developers and of applying the developer in controlled conditions which cause an "electrical breakdown" of the developer mixture between the applicator and the image member causes a remarkable increase in the extent of development, i.e., the quantity of toner transferred to the image member.

We have observed that, although partially-conductive developer mixtures offer advantages in the breakdown development mode and other modes of development, certain non-uniformities exist in the development of large solid image areas with such mixtures. Specifically we have noted that certain portions (particularly leading and trailing edge portions) of large solid image areas are developed disproportionately in density (either much too light or much too dark). These non-uniform development effects can, in some instances, detract significantly from the overall image quality.

SUMMARY OF THE INVENTION

The present invention pertains to the problems outlined above and it is an object of the invention to provide improved electrographic development method and apparatus that have particular advantage in the development of large solid area image portions.

In general this inventive approach involves: (1) moving an electrostatic-image-bearing member past a development zone; (2) transporting successive quantities of partially-conductive developer through transfer relation with the moving member in a direction generally countercurrent to the member's movement and (3) transporting successive quantities of partially-conductive developer through transfer relation in a direction generally the same as said member's movement. Preferably, these sequential developer transports occur at separate locations and in the presence of an electrical reference potential(s), said countercurrent transport occurs first and at least one of (a) the relative velocity of developer transport at the separate locations and (b) the relative reference potential provided at the separate locations is predeterminedly controlled to balance development and achieve more uniform density throughout large solid area image portions.

BRIEF DESCRIPTION OF THE DRAWINGS

In the subsequent description of preferred embodiments and modes, reference is made to the attached drawings which form a part hereof and in which:

FIGS. 1 and 2 are schematic illustrations and diagrams indicating physical effects involved in the present invention.

DESCRIPTION OF THE PREFERRED EMBODIMENTS

Figure 3:
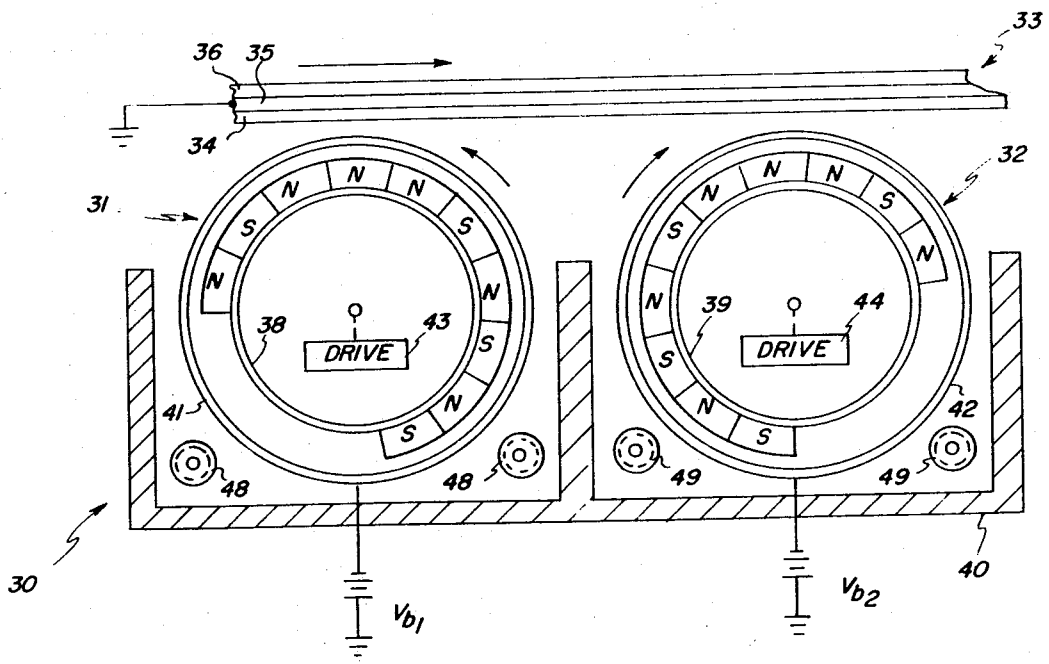
FIG. 3 is a schematic side view of one preferred embodiment of the present invention.

Before progressing to the description of particularly preferred modes and structures for practice of the present invention, a preliminary discussion of various physical phenomena believed to be occurring in development with partially-conductive developers, will be found useful. For this purpose reference is made to FIGS. 1 and 2 which each schematically illustrate an image member 1, e.g., a conventional photoconductor which has been charged and imagewise exposed, and is moving from left to right across a development station. The development station comprises a magnetic brush development system which is applying a partially-conductive developer mixture to develop a large solid area electrostatic image (in this instance a large block image of the letter H).

At this stage, an understanding of what is meant by "partially-conductive developer" is important. As used herein that term is intended to describe developer mixtures which exhibit electrical charge passing characteristics that are intermediate those of materials commonly thought of as conductors or insulators. One mode of specifying developer mixtures which fall within the contemplated scope of the term "partially-conductive", is by electrical resistance value in a given test condition. However, the electrical resistance of some developer materials changes from ohmic behavior and drops significantly in the presence of a high electrical field. This electrical breakdown can cause a developer not normally contemplated as partially-conductive to become what is contemplated as partially-conductive. It therefore is useful to alternatively define what is meant by partially-conductive developer in terms of the electrical breakdown characteristic.

Considered from the first viewpoint, developer mixtures are considered herein to be partially-conductive if they have an electrical resistance of less than $10^9$ ohms when measured in the following procedure. Using a cylindrical bar magnet ($\approx$560 Gauss North pole) having a circular end of 6.25 $cm^2$ area, a 15 gram quantity of developer mixture is attracted to said end and, while so supported, disposed about 0.5 cm from a burnished copper plate with the magnet end and plate surface being generally parallel. The resistance of the mixture is then measured between the bar magnet and the copper plate in generally room conditions (approximately 70° F. and 40% relative humidity) using an electrometer, e.g., a General Radio D.C., 1230-A, 6–9 volt or comparable type.

Considered from the viewpoint of electrical breakdown value, a developer mixture in question can be tested in its operating environment, e.g., with the actual state of electrical field, density, relative humidity, etc., in which it is utilized. If, when tested in such conditions, the developer undergoes a sudden drop in electrical resistance, "electrical breakdown" is said to have occurred. Developer mixtures which undergo such "electrical breakdown" can be useful in the present invention and are considered to be "partially-conductive" to the extent they exhibit such an electrical resistance drop in the actually utilized mode of operation. Developers which exhibit breakdown in fields of less than 25 volts per millimeter of developer thickness typically can be partially-conductive. Further discussion and examples of electrical breakdown and of developers which exhibit this characteristic are disclosed in U.S. Pat. No. 4,076,857 which is incorporated herein by reference.

Typical partially-conductive developers will comprise a toner and a carrier. The toner particles are usually relatively insulative. The carrier may be conductive itself, or a conductive additive may be added to the carrier to improve the conductivity of the developer, e.g., as in U.S. Pat. No. 2,919,247. Typical partially-conductive developer compositions include carriers such as iron, cobaltic oxide, stannic oxide, zinc and ferromagnesium, cupric carbonate, zinc carbonate, manganese carbonate, cupric oxide, lead acetate, zirconium, and nickel carbonate. Single component developers can also be partially-conductive.

Referring again to FIGS. 1 and 2, the magnetic brush assemblies 10 and 20 each comprise a rotary cylinder which in some conventional manner magnetically transports iron carrier particles to which electrographic toner is triboelectrically attracted. In these diagrams the electrostatic image is indicated as having a negative polarity so that typically the toner would be charged positively and the magnetic brush biased negatively to control background development, while also serving as a development electrode in the conventional sense.

Referring particularly to FIG. 1(*a*), it will be noted that brush 10 is rotated so that developer is moved across the development zone in a direction opposite, or countercurrent, to the direction of movement of the image member 1. After various experiments, we have noted that two identifiable effects repeatedly occur when developing large solid areas with partially-conductive developer in this mode. These are illustrated in simplified form in FIG. 1(*b*) where it can be noted that zones of depleted development exist along edges L of the block character H. Upon study of the character, it will be realized that the zones L each constitute the leading edge of a large solid area of the electrostatic image on the photoconductor, i.e., the edge first entering the development zone as the photoconductor moves from left to right. A second noted effect, which is illustrated in the diagram, is that zones T of the image are of density exceeding that further within the solid area. Generalizing it will be noted that each area T constitutes a trailing edge of a large solid area portion of the photoconductor, i.e., a portion of its solid area last residing in the development zone as the photoconductor moves from left to right.

After analysis of the phenomena connected with partially-conductive developers, we theorize that these described edge effects are caused by variations in the development field between the surface of the partially-conductive developer and the photoconductor surface. More specifically we theorize that, with partially-conductive developers, the effective development field (between developer surface and the charge-bearing photoconductor surface) increases in proportion to the amount of time which the developer surface exists in the presence of charged photoconductor surface.

In this regard consider a development system such as shown in FIG. 1*a*. As the leading edge of an image first moves in the development zone a like voltage is induced on the surface of the developer because of the capacitance of the developer. This initially induced voltage is of a magnitude which significantly affects the development field and thus limits the extent of development, i.e., toner transfer to the photoconductor. However, over a period of time in the presence of the photoconductor potential, the potential of the developer surface decreases because the partial conductivity of the developer allows charge leakage from the developer surface to the development roller. This decrease in potential of the developer surface increases the operative development field and thus the transfer of toner to the image. The rate of this development field (and thus development) increase is dependent to a large extent on the resistance-capacitance characteristic of the developer, and the developer can be viewed as having an RC time constant that causes an increase in development that is proportional to time in the presence of the photoconductor potential. It should be borne in mind, however, that in instances of developer breakdown such as described in U.S. Pat. No. 4,076,857, the development field increase will be more instantaneous, at some point after the developer is subjected to the photoconductor potential, than such increase would be with partially-conductive developers which do not undergo dielectric breakdown.

Thus the theorized model indicates that, with partially-conductive developer, more toner transfer will occur from developer which has existed for a period of time in the presence of the photoconductor potential than from developer which is newly subjected to the photoconductor potential. Comparing this theorized model to the FIG. 1 development diagrams, it will be seen that the observed results, FIG. 1*b*, are compatible with this theory. That is the leading edges L of block character are developed less than subsequent portions because the induced voltage on the developer surfaces contacting these portions is higher (and the development field therefore less) than on the developer surfaces which contact subsequent portions of the image.

Stated another way, as a leading edge of the large solid area moves into the development zone, the developer which contacts it has not previously resided in any substantial electrical field. Contrarily, the developer which contacts the trailing edges of large solid areas in the FIG. 1(*a*) development mode has had substantially more time in the electrical field between the electrostatic image and development electrode. If the developer does exhibit a time-varying response to the photoconductor potential (i.e., increasing the development field in proportion to time in the influence of such potential), one would expect that the leading edge would be less developed by the unconditioned developer. The trailing edge density would be expected to be greater because the development field of the time-conditioned developer to which it was subjected was proportionately greater. Experiments appear to confirm this analysis beyond the extent shown in FIG. 1(*b*), in that the image density actually appears to increase from leading to trailing edge across the entire large solid area. The more defined "edge effects" illustrated in FIG. 1(*b*) and in practice are more visually evident, being emphasized by fringe fields at image termini. An exemplary "density" versus "position-across-solid-area" curve is shown in the (c) portion of FIG. 1.

Referring now to FIG. 2(*a*), the development station there illustrated is the same as described with respect to FIG. 1(*a*) except that magnetic brush 20 is rotated so that developer moves through transfer relation with the photoconductor in the same (co-current) direction as the photoconductor. In FIG. 2(*b*) the edge effects noted in this mode of development are illustrated. Thus, it can be seen that the leading edge portions L of large solid areas are densely developed while the trailing edge portions T are weakly developed. We theorize the same physical mechanism to be in effect in this mode. Consider, a leading edge portion in this mode is subjected to developer which has been in the image field for a period which substantially exceeds the field conditioning period afforded the leading edge in the FIG. 1(*a*) mode. Thus additional developer conditioning time increases the effective development field and yields higher density. However, the trailing edge portion of the large solid areas in this mode are developed with developer which has not been in the presence of the electrostatic image and thus the effective development field for developer applied to the trailing edge portion is commensurately smaller. Hence the weakly developed trailing edge. An exemplary "density" versus "position-across-solid-area" curve is shown in the (c) portion of FIG. 2.

According to the present invention the phenomena described above can be organized and controlled to significantly enhance solid area development with partially-conductive developer. One structural embodiment for practice of the present invention is disclosed in FIG. 3. The development apparatus 30 there illustrated comprises two magnetic brushes 31, 32 mounted at a development station along the path of an electrographic image member 33. The image member can be of various types known in the art, e.g., including a photoconductive insulator layer 34, an electrically conductive backing layer 35 and a film support 36. Each of magnetic brushes 31, 32 respectively comprises an array of strip magnets, denoted N and S, arranged as shown around the periphery of innercores 38 and 39, which are stationary within developer reservoir 40. Each brush also includes an electrically conductive outer cylinder 41 and 42 respectively, which is non-magnetic and rotatable around the core to transport developer mixture, attracted by the magnets N and S, from the reservoir 40 into contact with the image member 33 and back into the reservoir to be replenished. To facilitate uniform distribution of developer longitudinally across the brush surface, augers 48, 49 can be provided in the reservoir as shown. Preferably, the augers have a pitch which varies longitudinally to equalize the quantity of developer supplied. It is to be noted that the cylinders 41 and 42 of brushes 31 and 32 are rotated in different directions, as indicated, by drive means 43, 44 respectively, and that each cylinder has a separate electrical bias from respective potential sources $Vb_1$ and $Vb_2$.

In operation the image member 33 is moved as shown across the development apparatus as the magnetic brushes 31 and 32 are rotated in the directions described and shown. It will be appreciated that a large solid area on the image member will thus be subjected sequentially to the development effect shown in FIG. 1, then the development effect shown in FIG. 2. The purpose of this approach can be generalized by considering the resulting overall density of an image exiting the development station as directly related to the sum of the individual densities provided by the rollers acting separately, i.e., adding the curves shown in FIGS. 1(*c*) and 2(*c*). We have found that this combination does in fact result in improvement as to edge effects; however, there are other parameters which can be controlled to optimize the resultant development.

Thus, the density curve, such as FIG. 1(*c*) and 2(*c*), representing the development by each individual brush acting alone would vary depending upon the speed of rotation and/or the bias applied to the brush. There are also interrelated effects between the two separate brushes, for example the density provided by the second operating brush is less because the electric field due to the photoconductor charge is less after development by the first operating brush. Optimum results can be achieved by controlling one or both of the speed of rotation and bias to obtain approximately equal density for the leading and trailing edge portions of a large solid area. This optimum condition of operation can be fine-tuned empirically for a given system, but the following general criteria have been found to result in preferred modes of operation. First, it is usually necessary that developer transported by the co-current rotating brush have a velocity at least equal to the velocity of the photoconductor surface. Second it is generally preferred that the brush members be rotated so that the relative velocities of their peripheral surfaces with respect to the moving photoconductor do not differ greatly. Given the above criteria and relative brush diameters, generally appropriate rotational rates can be selected for the brushes. For example, with brushes of equal diameter (about 7.62 cm) and with a photoconductor moving at about 25.4 cm/sec we have found desirable peripheral speeds to be about 23.88 cm/sec for the countercurrent brush and 71.88 cm/sec for the co-current brush. The optimum rotational rates will vary with photoconductor speed, developer conductivity and other system parameters, e.g., brush bias.

In selecting appropriate brush bias it is usually preferred that the bias of the downstream brush member (e.g., $Vb_2$ of brush 32 in FIG. 3) be greater than the background potential of the photoconductor image. This minimizes any extraneous background development. A highly preferred mode of operation provides a bias on the upstream brush which is significantly less than the bias on the downstream brush, to provide for as complete development of the electrostatic image as possible. In this regard the bias of the upstream roller could be such as to cause "breakdown" development. In connection with photoconductor and brush speeds as described above and with an electrostatic image having 500 volt image and 125–250 volt background charge, we have found it desirable to bias the upstream roller in the range of 50 to 125 volts and the downstream roller in the range of 125 to 250 volts.

Lastly, it has been found highly preferable to have the last downstream brush rotating in a co-current direction. This provides enhanced results in smoothness of the large solid area images.

It is important to note that highly useful results can be achieved according to the present invention without compliance with all of the foregoing criteria. The essential aspect is that at least one brush be rotated co-current and at least one brush be rotated countercurrent to the direction of the photoconductor and that one or more of the development influencing parameters (i.e., relative brush velocities or biases) be controlled to provide approximately equal density development for leading and trailing edge portions of solid area images.

By way of further teaching of typical parameters useful for practice of the present invention, the following more detailed example of a specific development system will be useful. A two-magnetic-brush device constructed generally as shown having outside cylinder diameters of 7.62 cm, was used, and the magnets were elongated strips arranged as shown in FIG. 3. The developer was a mixture of polymer coated iron particles and toner which had a resistance of about $10^8$ ohm when measured by the procedure outlined previously herein. The image member comprised an organic photoconductor overlying a metallized surface of a flexible plastic belt and was moved over the development device in the direction shown in FIG. 3 at a linear velocity of about 25.4 cm/sec. The photoconductor was charged originally to a potential of about −400 volts and imagewise exposed to a pattern having large solid area portions. Background portions of the resultant electrostatic image were discharged by the exposure to a potential of about −100 to −150 volts. The first countercurrently rotating brush was rotated at about 100 RPM and biased to a potential of −80 volts. The second co-currently rotating brush was rotated at about 140 RPM and biased to about −150 volts. The rotating shells of both brushes were spaced about 2.54 mm from the moving photoconductor surface and the brushes were spaced center-to-center about 13 cm. The resultant image developed by this system was smooth and uniform with a maximum density of about 1.2. Solid areas of the image exhibited balanced leading and trailing edge density. Typed characters on the image were clean and possessed high density and fine line development was excellent. Background areas of the image were clean, i.e., did not have extraneous toner thereon.

It will of course be understood that the present invention is not limited to the particular configurations shown in the drawings and described above. For example in certain applications it may be highly useful to have more than two magnetic brush members, with one or more rotating in opposite directions. The brushes need not contact an image member along a linear path but could be disposed around the periphery of an image drum. The particular magnetic brush construction is not critical; as is known in the art such members can take many forms for example with stationary outer cylinders and rotating magnets or with various other known modifications. Beyond this the present invention may be utilized with other development systems than magnetic brush, provided suitable application means are provided to transport developer through separate portions of the development zone in co-current and countercurrent directions. Separate cascade systems may be envisioned for this purpose or combinations of cascade or other application systems with magnetic brush development can be utilized.

Although the preferred embodiment for practice of the invention provides separate development stations, lower speed implementation of the invention could utilize a single applicator which sequentially applies developer to the moving image member in the defined manner. For example, a translating image member could be moved across a rotating brush, first in one direction and then in the opposite direction. Or, the brush could be translated to provide equivalent results. Similarly, the image member could make sequential passes in the same direction with the direction of brush rotation reversed to provide the desired development. Other variations may occur to those skilled in the art.

The invention has been described in detail with particular reference to certain preferred embodiments thereof, but it will be understood that variations and modifications can be effected within the spirit and scope of the invention.

We claim:

1. A method of developing an electrostatic image on the surface of an image member, said method comprising:

(a) moving said member past a development zone in a downstream direction;

(b) at a first location in said zone transporting partially-conductive electrographic developer across said surface in a direction generally opposite said downstream direction; and (c) at a second location in said zone transporting partially-conductive developer across said surface in generally said downstream direction.

2. The method defined in claim 1 wherein the velocities of developer transport at said first and second locations are of different magnitudes which are predeterminedly selected to balance the density of development of leading and trailing edge portions of solid-area images on said member.

3. The method defined in claim 2 wherein said second location is downstream of said first location.

4. The method defined in claim 1 wherein developer transport at said first and second locations is respectively in the presence of first and second reference potentials which are predeterminedly selected to balance the density of development of leading and trailing edge portions of solid-area images on said member.

5. The method defined in claim 4 wherein said first location is upstream of said second location and wherein the reference potential at said first location is substantially less than at said second location.

6. The method defined in claim 1 wherein said developer is transported at both locations by a magnetic brush.

7. The method defined in claim 1 wherein said developer comprises a triboelectric mixture of carrier particles and toner particles having a resistance of less than $10^9$ ohms.

8. A method of developing an electrostatic image on the surface of an image member, said method comprising:

(a) moving said member past a development zone in a downstream direction;

(b) at a first location in said zone and in the presence of a first reference potential, transporting electrographic developer comprising a triboelectric mixture of carrier particles and toner particles having a resistance of less than $10^9$ ohms across said surface in a direction generally opposite said downstream direction; and (c) at a second location in said zone downstream from said first location and in the presence of a second reference potential higher than said first reference potential, transporting such developer across said surface in generally said downstream direction.

9. The method defined in claim 8 wherein the velocities of developer transport and the reference potentials at said first and second locations are predeterminedly selected to balance the density of development of leading and trailing edge portions of solid-area images passing through said development zone.

10. A method of developing an electrostatic image on the surface of an image member, said method comprising:

(a) moving said member past a development zone;

(b) transporting partially-conductive electrographic developer across said surface in a direction generally countercurrent to the movement of said member; and (c) transporting partially-conductive developer across said surface in a direction generally co-current with the movement of said member.

11. The invention defined in claim 10 wherein the sequential developer transports occur at separate locations in said development zone and in the presence of electric reference potential, said countercurrent transport precedes said co-current transport and at least one of (a) the relative velocity of developer transport and (b) the reference potential at said separate locations is predeterminedly controlled to balance development of portions of said electrostatic image.

* * * * *